US006422736B1

(12) United States Patent
Antoniades et al.

(10) Patent No.: US 6,422,736 B1
(45) Date of Patent: Jul. 23, 2002

(54) SCALABLE IMPELLER APPARATUS FOR PREPARING SILVER HALIDE GRAINS

(75) Inventors: Michael G. Antoniades, Rochester, NY (US); Harold G. Judd, Bolingbrook, IL (US); Katrin I. Parsiegla, Rochester, NY (US); Benjamin T. Chen, Penfield, NY (US); Douglas E. Singer; Donald R. Irwin, both of Rochester, NY (US); Sucheta Tandon, Fairport, NY (US); Jess B. Hendricks, III, Rochester, NY (US); Heinz E. Stapelfeldt, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/598,573

(22) Filed: Jun. 21, 2000

(51) Int. Cl.[7] ..... B01F 7/22

(52) U.S. Cl. ..... 366/172.2; 366/264; 366/270; 422/227

(58) Field of Search ..... 366/262–265, 366/270, 302, 306, 307, 172.2; 422/224–228, 231; 416/179, 189, 191, 192; 415/220, 221

(56) References Cited

U.S. PATENT DOCUMENTS 975,380 A * 11/1910 Berntson
1,504,776 A * 8/1924 Nagler
1,696,776 A * 12/1928 Menge
1,763,379 A * 6/1930 Thurm et al.
1,786,009 A * 12/1930 Duwe
2,134,571 A * 12/1938 Morlock
2,194,666 A * 3/1940 Meissner
2,212,261 A * 8/1940 Brothman
2,291,937 A * 8/1942 Young
2,363,834 A * 11/1944 Crater
2,438,204 A * 3/1948 Castner
2,460,987 A * 2/1949 Kanhofer
2,592,112 A * 4/1952 Bradshaw et al.
3,415,650 A * 12/1968 Frame et al.
3,572,658 A * 3/1971 Ravitts
4,289,733 A 9/1981 Saito et al.
4,378,165 A * 3/1983 Landberg
4,437,765 A * 3/1984 Seeger
4,490,335 A * 12/1984 Marev et al.
4,666,669 A * 5/1987 Mumaw
4,798,131 A * 1/1989 Ohta et al.
4,919,849 A * 4/1990 Litz et al.
5,084,252 A * 1/1992 Cahill et al.
5,248,613 A * 9/1993 Roubicek
5,505,541 A * 4/1996 Kihara
5,650,100 A * 7/1997 Just
5,762,417 A * 6/1998 Essen et al.
6,050,720 A * 4/2000 Tuyuki
2001/0055237 A1 * 12/2001 Kubera et al. ..... 366/264

FOREIGN PATENT DOCUMENTS

DE 486215 * 10/1929
JP 3-5326 * 1/1991

OTHER PUBLICATIONS

"Fluid Mixing Technology" by James Y. Oldshue, McGraw Hill Publishing Co., 1983 Journal of Imaging Science and Technology, vol. 43, pp. 85–88, H. Coll and R.E. Button.

* cited by examiner

*Primary Examiner*—Charles E. Cooley
(74) *Attorney, Agent, or Firm*—Clyde E. Bailey, Sr.

(57) ABSTRACT

A mixer for preparing silver halide grains for photographic use has upper and lower impellers housed in a draft tube. The bottom impeller has flat blades for micromixing silver and halide reactants introduced into the bottom of the draft tube. The upper impeller has pitched blades for macromixing the bulk fluid. The impellers are spaced apart at least the distance of their diameters so that the upper and lower impellers operate independently of one another so that micromixing is independent of macromixing. A flow disrupter structurally associated with the draft tube and positioned above the top impeller prevents vortexing of the fluid during mixing. Baffles may be provided in the draft tube to discourage vortexing.

15 Claims, 2 Drawing Sheets

SCALABLE IMPELLER APPARATUS FOR PREPARING SILVER HALIDE GRAINS

FIELD OF THE INVENTION

The present invention relates generally to a mixer for preparing silver halide emulsions for photographic use, and, more particularly, to a mixer that facilitates separate control of reactant dispersion (micromixing) and bulk circulation in the precipitation reactor (macromixing).

BACKGROUND OF THE INVENTION

Silver halide grains can be formed by the double decomposition reaction of a water soluble silver salt solution and a water soluble halide solution. For photographic use, the goal is to produce silver halide grains of narrow grain size distribution because small grains of uniform size produce higher quality photographs than large grains or randomly distributed grains. In producing silver halide grains, two actions occur. First, there is micromixing where the individually introduced silver and halide solutions react to form silver halide grains. Second, there is macromixing, where the silver halide grains are circulated in the bulk liquid. Conventional mixers present several problems such as construction complexity, difficulty of cleaning, and air entrainment.

A mixer is disclosed in U.S. Pat. No. 4,289,733 that addresses several previously existing problems, and also points out the problem with conventional mixers that the degree of mixing within the mixing device and the circulation of the bulk liquid are both dependent on the rotation of the mixing device. However, the mixer disclosed therein does not completely solve this problem. Careful characterization of this prior mixing device reveals that the degree of mixing within the mixing device (micromixing) and the circulation of the bulk liquid through the mixing device (macromixing) cannot be independently controlled. Therefore, in scale-up operations where both micromixing and macromixing are key parameters that must be scaled, a problem still exists with prior mixing devices. It is desirable to have a mixer with improved robustness (i.e., reduced variability in particle size, size distribution, morphology and sensitometry) and scalability at all scales, while maintaining or improving photographic performance.

SUMMARY OF THE INVENTION

The present invention is directed to overcoming one or more of the problems set forth above. According to one aspect of the present invention, a scalable apparatus for preparing silver halide grains, comprises a vertically oriented draft tube, a bottom impeller positioned in the draft tube, and a top impeller positioned in the draft tube above the first impeller and spaced therefrom a distance sufficient for independent operation.

The mixer facilitates separate control of reactant dispersion (micromixing) and bulk circulation in the precipitation reactor (macromixing). This is achieved by the use of a draft tube, which houses two different impellers. The bottom impeller is a flat blade turbine (FBT) and is used to efficiently disperse the reactants, which are added at the bottom of the draft tube. The top impeller is a pitched blade turbine (PBT) and is used to circulate the bulk reactor fluid through the draft tube in an upward direction providing a narrow circulation time distribution through the reaction zone. Appropriate baffling is used to avoid vortexing and air entrainment. The two impellers are placed at a distance such that independent operation is obtained. This independent operation and the simplicity of its geometry are key features that make this mixer well suited in the scale-up of silver halide precipitation processes.

The impellers are placed at a distance that is shown to facilitate independent operation. Then, for scale up operations both the mixer rotation speed and the pitch angle of the upper impeller can be changed to simultaneously match micromixing and macromixing. For instance, if the only important parameter to be scaled is the bulk circulation, then, geometric similarity is used from one scale to another and the rotation speed is kept the same. On the other hand, if both reactant dispersal and bulk circulation are important parameters, then, geometric similarity is used, the rotation speed is changed to match power dissipation from one scale to another and the pitch angle of the upper impeller is changed in order to also match the bulk circulation from one scale to another.

In addition to the scalability, another advantage of the mixer is related to the morphology of cubic AgCl grains. With conventional radial mixing devices the cubicity of the AgCl grains is dependent on the mixing speed. With the present invention, mixing sensitivity of AgCl grain cubicity is significantly lower and not dependent on impeller speed, meaning that scale up of such grains should be easier. Another advantage is that, in the absence of antifoggants, R-typing is lower compared to conventional radial mixing devices. Another advantage of the new mixing device is that the reactant introduction process is very robust because of the efficient dispersing power of the lower impeller, and no reactant distribution or spreading is necessary.

The above and other aspects, objects, features and advantages of the present invention will become more apparent from a study of the detailed description of the invention and by reference to the accompanying drawings.

DESCRIPTION OF THE PREFERRED EMBODIMENTS

Figure 2:
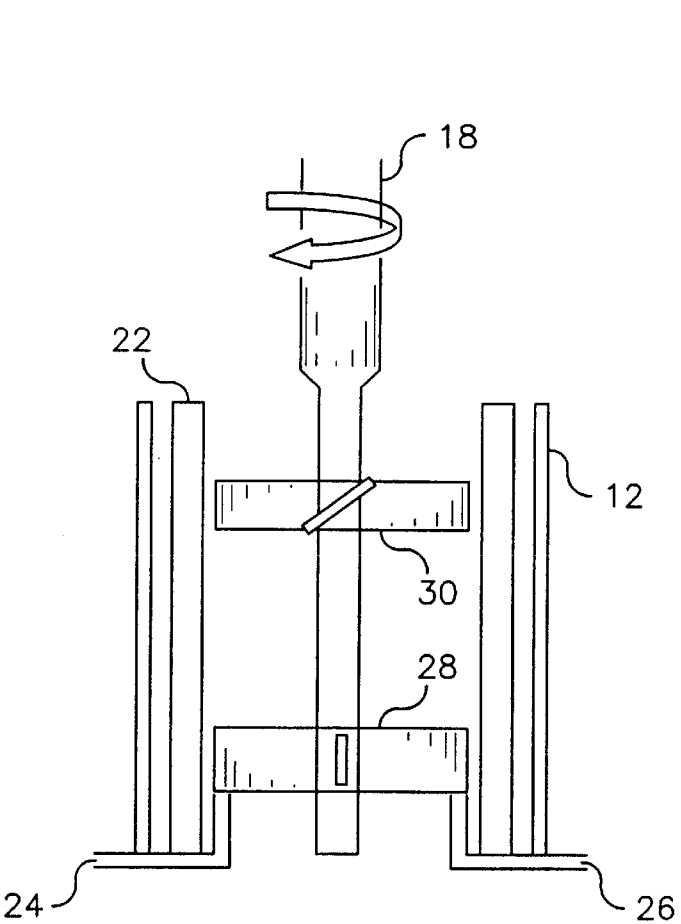
FIG. 2 is a diagrammatic vertical sectional view of the mixer of FIG. 1 further illustrating the draft tube and impellers.
Figure 1:
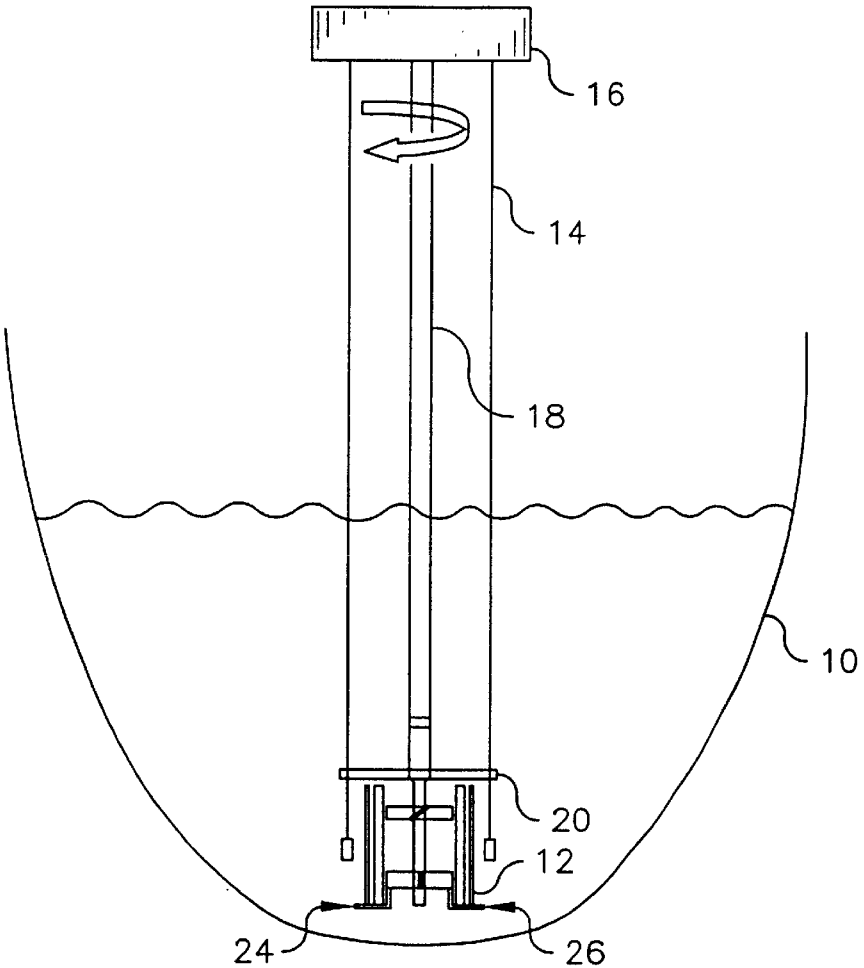
FIG. 1 is a diagram illustrating a preferred embodiment of a mixer for preparing silver halide photographic emulsions in a mixing vessel including a motor and disrupter according to the present invention.
Figure 3:
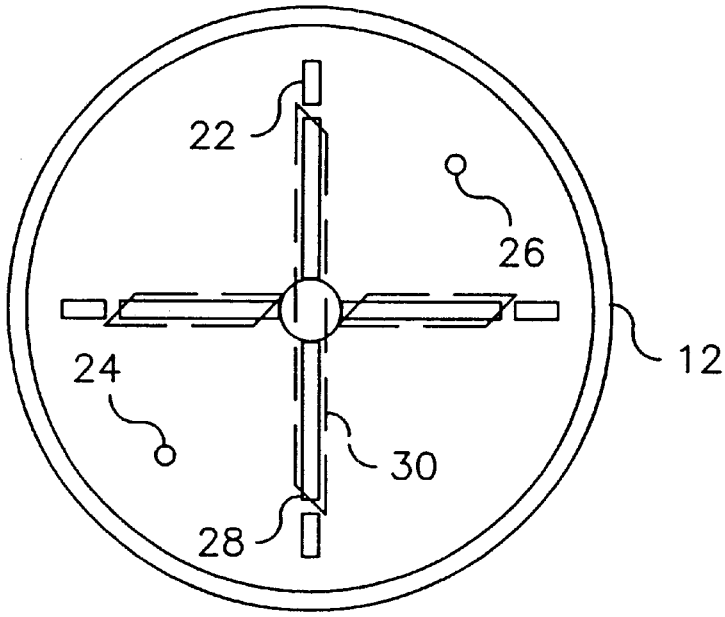
FIG. 3 is a top view of the mixer.
Figure 4:
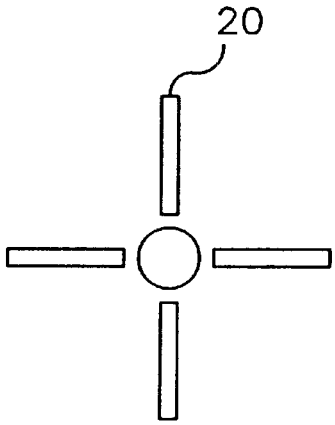
FIG. 4 is a top view of the disrupter of FIG. 1.

Referring to FIGS. 1–4, a mixer, for preparing photographic silver halide emulsions for example, has a containment vessel 10 which holds the emulsion and apparatus for mixing the emulsion. A draft tube 12 located in vessel 10 is positioned near the bottom of the vessel to circulate the fluid. Draft tube 12 is preferably suspended on support rods 14 attached to a support that can also support motor 16. Shaft 18 extends downward from motor 16 into draft tube 12, and, as illustrated, rotates in a clockwise direction as viewed from the top of the containment vessel. A flow disrupter 20 fits about shaft 18 at the top of draft tube 12 to control vortexing. The disrupter illustrated has four arms spaced 90° apart.

The draft tube 12 is cylindrical and is vertically oriented with its vertical axis coincident with the vertical axis of shaft 18. A baffle 22 is positioned in the tube either along the inner sidewall or spaced from the inner sidewall to control vortexing and air entrainment. It preferably extends substantially the entire length of the tube. The baffle illustrated contains four segments with each segment spaced 90° from the next segment.

At the bottom of the tube are inlet tubes 24 and 26 which introduce a silver reactant and a halide reactant into the fluid as is known in the art. Inlet tubes 24, 26 are aligned with a diameter of the tube and positioned on opposite sides the vertical axis so that they are 180° apart.

There are two impellers 28 and 30 mounted on the shaft 18 for rotation with the shaft. The bottom impeller 28 is positioned in the bottom portion of the draft tube and has a plurality of blades. Each of the blades has a vertically oriented working surface giving the blades a 90° pitch angle. The flat blades disperse the reactants delivered through inlet tubes 24, 26 to the bottom of the draft tube. The flat blades disperse or micromix the silver and halide reactants into the bulk fluid.

The top impeller 30 also has a plurality of blades with each blade having a flat or planar working surface. Each blade is angled upward from horizontal to direct the bulk fluid upward in the tube. The top impeller circulates the bulk reactor fluid through the draft tube providing a narrow circulation time distribution through the reaction zone to form silver halide grains of predetermined size. In the direction of rotation, with the leading edge of a blade at horizontal, the trailing edge is elevated from horizontal in a range of from about 15 to 45 degrees.

The top impeller 30 is spaced a distance from the bottom impeller that is equal to or greater than 50% of the diameter of the bottom impeller, more preferably 75% of the diameter of the bottom impeller, and most preferably 100% of the diameter of the bottom impeller. This distance is required to maintain independence of operation between the impellers; that is, the physical separation is required so that micromixing and macromixing are separated. This separation or independence allows flexibility in choosing the mixing conditions that are optimal for the particular type of emulsion; it is accomplished by locating the pitched blade upper impeller near the top end exit of the draft tube. The upper impeller provides a high flow to power ratio which is easily varied. Power dissipation may be expressed as $P=\rho N_p n^3 D^5$, where ρ is density, $N_p$ is power number, n is mixing speed and D is impeller diameter which governs micromixing. The flow of bulk fluid through the draft tube may be expressed as $Q=N_q n D^3$, where $N_q$, is the flow number that governs the macromixing and the circulation time distribution.

The impeller pumping rate can be measured as a function of its speed in rpm using a dynamic flow balance technique:

$$\text{Pumping}=\text{flow number}(N_q)\times\text{stirring speed}\times\text{impeller diameter}^3.$$

Measured data shows that the pumping rate depends on the pitch of the impeller blades. Pumping is substantially higher for pitched blades than for flat blades. The upper and lower impellers operate independently when the top impeller is spaced a distance from the bottom impeller that is 100% of the diameter of the bottom impeller as verified by the sum of the flow numbers for each impeller being nearly equal to the measured flow number of the combined impellers. Flow numbers are listed in Table 1 for 0.4 decimeter impellers where the top impeller is spaced from the bottom impeller by a distance that is 100% of the diameter of the bottom impeller.

TABLE 1

| CONDITION | MEASURED Nq | SUM OF Nq |
|---|---|---|
| FBT only | −0.124 | |
| 15° PBT only | 0.205 | |
| 30° PBT only | 0.535 | |
| 45° PBT only | 0.613 | |
| FBT and 15° PBT | 0.065 | 0.081 |
| FBT and 30° PBT | 0.359 | 0.411 |
| FBT and 45° PBT | 0.453 | 0.489 |

Power dissipation was measured as a function of blade configuration and impeller speed. Power dissipation determinations were made by measuring shaft torque using a rotary transformer dynamometer:

$$\text{watts}=\text{power number}(N_p)\times\text{stirring speed}^3\times\text{impeller diameter}^5\times\text{fluid density}.$$

Measured data shows that the power dissipation rate of the flat blade impeller is substantially higher that that of the pitched blade impeller. The upper and lower impellers operate independently when the top impeller is spaced a distance from the bottom impeller that is 100% of the diameter of the bottom impeller as verified by the sum of the power numbers for each impeller being nearly equal to the measured power number of the combined impellers. It was also found that the presence of the draft tube actually increases the dissipation by about 11% for a given speed. Power numbers are listed in Table 2 for 0.4 decimeter impellers where the top impeller is spaced from the bottom impeller by a distance that is 100% of the diameter of the bottom impeller.

TABLE 2

| CONDITION | MEASURED Np | SUM OF Np |
|---|---|---|
| FBT only | 3.703 | |
| 15° PBT only | 0.411 | |
| 30° PBT onlY | 0.767 | |
| 45° PBT only | 1.324 | |
| FBT and 15° PBT | 3.542 | 4.115 |
| FBT and 30° PBT | 3.943 | 4.470 |
| FBT and 45° PBT | 4.573 | 5.027 |

Comparable results were obtained using another test. That test was conducted to verify the separation of the hot zone mixing from the bulk mixing by dispersing oil in water and observing the resulting droplet size produced. The final droplet size corresponds to the maximum intensity of the mixing that the dispersion is subjected to, thereby giving a quantitative measure of the maximum power dissipation rate that exists in the system. All the droplet sizes fall on the same model correlation regardless of the pitch angle of the upper impeller used. This indicates that the upper impeller has no effect on the intensity of mixing in the hot zone.

The independent operation of the two impellers, and the consequent independence of the two parameters Q and P facilitate scale-up as follows. When scaling up, both of these parameters must be scaled appropriately in most cases. For example, when scaling up by a volume scale factor of S, then both the flow of bulk fluid through the draft tube, Q, and power dissipation in the draft tube, P, should be scaled by a factor of S. When geometric similarity is preserved from one scale to another, and when the mixer dimensions are scaled by a factor of $S^{1/3}$ then Q is automatically scaled by a factor of S as is demonstrated below.

Let $D_1$ be the turbine diameter at the small scale. If geometric similarity is preserved then, the diameter of the turbine at the large scale, $D_2$, is given by $$D_2=D_1S^{1/3} \quad \text{Eq-1}$$

The fluid flow through the draft tube at the small scale would be $$Q_1=N_Q n D_1^3 \quad \text{Eq-2}$$

where $N_Q$ is the flow number and n is the mixer speed. Similarly, the circulation flow for the large scale is $$Q_2=N_Q n D_2^3 \quad \text{Eq-3}$$

If the flow number, $N_Q$, is the same for both scales (true with geometric similarity), and the same mixer speed is used, substitution of Eq-1 and Eq-2 into Eq-3 yields $$Q_2=Q_1S \quad \text{Eq-4}$$

Therefore, with geometric similarity and the same mixer speed, the circulation flow scales appropriately by the scale factor. Or, the flow through the draft tube per unit volume (total volume or draft tube volume) is constant from scale to scale.

On the other hand, that is not true for the power dissipation per unit volume, as shown below. The power dissipation per unit draft-tube volume, $P_1$, for the small scale is given by $$P_1 = \frac{1}{V_1} N_p n^3 D_1^5 \rho \quad \text{Eq-5}$$

where Np is the power number, ρ is the density, and $V_1$ is the volume of the draft tube. Similarly, for the large scale the power dissipation per draft-tube volume is given by $$P_2 = \frac{1}{V_2} N_p n^3 D_2^5 \rho \quad \text{Eq-6}$$

Since the draft tube volume is scaled by a factor of S, then $V_2=V_1S$. Substituting Eq-1 and Eq-5 into Eq-6 we get $$P_2=P_1S^{2/3} \quad \text{Eq-7}$$

assuming as previously that the power number is the same for the two scales and the mixer speed is the same. Hence, as the scale size increases (S>1) the power dissipation per unit volume increases.

Therefore, in the special case when P does not significantly affect the result of interest and only Q must be scaled, then as shown above, geometric similarity, scale up of dimensions by a factor of $S^{1/3}$ and the same mixing speed, are the conditions required for scale up. However, if both Q and P must be scaled, a different approach is needed. In this case, in addition to scaling the mixer dimensions by a factor of $S^{1/3}$, both the mixing speed and the pitch angle of the PBT can be changed in a way as to properly scale Q and P simultaneously. This is demonstrated in Tables 3A and 3B, for a ten-fold scale up where the top impeller is spaced from the bottom impeller by a distance that is 100% of the diameter of the impellers.

TABLE 3A

| Relative Scale | Speed (RPM) | Pitch Angle (°) | Diameter (cm) | Flow Numbers | Q (L/min) | Power Numbers | P (Watts/L) |
|---|---|---|---|---|---|---|---|
| 1 | 2690 | 18 | 4.0 | 0.132 | 22.7 | 3.65 | 199 |
| 10 | 1600 | 21 | 8.6 | 0.220 | 227 | 3.70 | 199 |

TABLE 3B

| Relative Scale | Speed (RPM) | Pitch Angle (°) | Diameter (cm) | Flow Numbers | Q (L/min) | Power Numbers | P (Watts/L) |
|---|---|---|---|---|---|---|---|
| 1 | 3840 | 18 | 4.0 | 0.132 | 32.4 | 3.65 | 580 |
| 10 | 2290 | 21 | 8.6 | 0.220 | 324 | 3.70 | 580 |

The present invention provides intense micromixing; that is, it provides very high power dissipation in the region of reagent introduction. Rapid dispersal of the feed streams, particularly, silver nitrate, is important in controlling several key factors in emulsion making, such as R-typing, formation of deposits on the mixer, and the segregation of halide ion concentration and supersaturation. The more intense the turbulent mixing is in the feed zone, the more rapidly the feed will be dissipated and mixed with the bulk. This is accomplished using a flat bladed impeller and feeding the reagents directly into the discharge zone of the impeller. The flat bladed impeller possesses high shear and dissipation characteristics using the simplest design possible.

The present invention provides superior bulk circulation, macromixing, with minimal air entrapment. Rapid homogenization rates and narrow circulation time distributions are desirable in achieving superior emulsion characteristics, such as grain uniformity. This is accomplished by employing an axial upward directed flow field, which is further enhanced by the use of a draft tube. This type of flow provides a single continuous circulation loop with no dead zones, and the upward direction of flow helps to disrupt the surface vortex. In addition to directing fluid motion in an axial direction, the draft tube provides the means to run the impeller at much higher rpm, and confines the reaction zone to the intensely mixed interior of the tube. To further stabilize the flow field, a disrupter device is attached to the discharge of the draft tube, reducing the rotational component of flow and thereby reducing the propensity for vortex formation.

The present invention provides a means for easily changing the power dissipation independently from the bulk circulation. This allows flexibility in choosing the mixing conditions that are optimal for the particular type of emulsion being used. This separation of bulk and hot zone mixing is accomplished by locating the pitched bladed impeller near the exit of the draft tube. The pitch bladed impeller provides a high flow to power ratio, which is easily varied, and is a simple design. It controls the rate of circulation through the draft tube, the rate being a function of the pitch angle of the blades, number and size of blades, etc. Because the pitch bladed impeller dissipates much less power than the flat bladed impeller, and is located sufficiently away from the feed point, the pitch bladed impeller does not interfere with the intensity of hot zone mixing in the draft tube, just the circulation rate through it. By placing the impellers a certain distance apart, this effect of independent mixing is maximized. The distance between the impellers also strongly affects the degree of back mixing in the hot zone, and hence provides yet another mixing parameter that can be varied.

The invention can be further appreciated by reference to the following specific examples.

EXAMPLE 1

This example demonstrates that upon scale up, the size and morphology of a cubic silver chloride photographic emulsion prepared by the mixer disclosed herein remained unchanged. A mixer according to the description of FIGS. 1, 2, and 3, with the dimensions of 15 cm for the length of the draft tube, 12.9 cm for the inside diameter of the draft tube, with turbines of 8.6 cm in diameter, and with a pitch of 45° on the PBT was used to prepare a control cubic silver chloride photographic emulsion as follows.

A reaction vessel was charged with 90 Kg of water, 2.5 Kg of gelatin and 15.9 g of antifoamant at 68° C. To this 2.55 L of a 3.8 M NaCl solution and 375 mL of an aqueous solution containing 18.75 g of 3,6-dithiooctane-1,8-diol ripener were added. Then, a 3.72 M solution of $AgNO_3$ was added at a rate of 1.12 Kg/min for 45.6 min while the mean pCl of the reactor was maintained at 1.0 by adding a 3.8 M solution of NaCl.

This emulsion was also prepared at a 10×larger scale. In this case, the above mentioned dimensions of the mixer were increased by the cube root of the scaling factor, 10 (i.e., by a factor of 2.15) as discussed earlier. The pitch of the PBT for the larger mixer was the same as the control (45°). Therefore, in this case the bulk fluid through the draft tube, Q, was increased by the scaling factor but the power dissipation per unit volume in the draft tube was increased by a larger factor, as discussed earlier. In addition, the initial reactor volume and the flow rates were increased by a factor of 10.

The same morphology grains were produced in both cases. The cubic edge length (CEL) and coefficient of variation (COV) for the two scales were measured, where the COV is the ratio of the standard deviation of the grain volume and the mean grain volume. The experiment was repeated at two different mixing speeds, given in revolutions per minute (RPM) of the mixer shaft, and the results are shown in Table 4.

TABLE 4

| Mixer Speed | Control | | 10X Scale up | |
|---|---|---|---|---|
| (RPM) | CEL (μm) | COV | CEL (μm) | COV |
| 1270 | 0.603 | 0.277 | 0.607 | 0.278 |
| 890 | 0.602 | 0.313 | 0.596 | 0.300 |

As shown in Table 4 upon a 10×scale up the crystal size changes by less than 1%. Those skilled in the art know that in general the scale up of such emulsions is difficult and that the mixing rate has an effect on the morphology and size. As expected, the COV increases as the mixing speed is decreased due to the broadening of the circulation time distribution.

EXAMPLE 2

In this example it is demonstrated that the roundness of AgCl cubes prepared by the mixer disclosed by this invention was less sensitive to the mixer speed than conventional mixers. The mixer used in this comparison was according to the description of FIGS. 1, 2, and 3, with the dimensions of 7 cm for the length of the draft tube, 6 cm for the inside diameter of the draft tube, with turbines of 4 cm in diameter, and with pitch angles of 45° (45°PBT), 30° (30°PBT) and 15° (15° PBT) on the PBT. A commercially available Rushton turbine with a diameter of 5 cm and with six fins was also used for this comparison, hereinafter referred to as RT-6. The Rushton turbine is a radial flow impeller comprising of a flat, horizontal disk, with flat, protruding fins attached to the disk at 90° from the horizontal. This impeller has high power dissipation and is extensively used in the chemical processing industry. Such commercially available turbines have been described in the literature, as for example in "Fluid Mixing Technology" by James Y. Oldshue, McGraw Hill Publishing Co., 1983.

The effect of the mixing rate on the roundness of AgCl cubes was examined using the same precipitation formula as that of the control in Example 1 except that the initial reactor volume and the flow rates were decreased by a factor of 10. The mixer dimensions were also decreased by the cube root of the scaling factor 10 (i.e., by a factor of 2.15) and are as specified above. In all cases the mixing speed was varied by factors of 1.5×and 3×and the roundness of the AgCl grains was measured by the method described in *J Imaging Sci. Technol.*, vol. 43, p 85, H. Coll and R. E. Button. The roundness index (RI) defined therein (sphere has a RI of 1 and perfect cube has a RI of 0) for each resulting emulsion is given in Table 5. The mixing speeds for the 45° PBT and the RT-6 were selected so as to produce comparable power dissipation. The mixing speeds for 30° PBT yield the same bulk circulation flow rate through the draft tube as 45° PBT but higher power dissipation or micromixing. The mixing speeds for 15° PBT give the same power dissipation as 45° PBT but lower bulk circulation flow rate through the draft tube.

TABLE 5

| 45° PBT | | 30° PBT | | 15° PBT | | RT-6 | |
|---|---|---|---|---|---|---|---|
| RPM | RI | RPM | RI | RPM | RI | RPM | RI |
| 980 | 0.165 | 1230 | 0.176 | 1070 | 0.168 | 700 | 0.189 |
| 1960 | 0.184 | 2470 | 0.183 | 2130 | 0.172 | 1390 | 0.261 |
| 2940 | 0.214 | 3700 | 0.188 | 3200 | 0.187 | 2090 | 0.335 |

As seen from Table 5 in all cases the mixer disclosed produces AgCl cubes that are less rounded (i.e., more cubic)

than those produced by the commercially available mixer. Moreover, the cubicity of the emulsions produced by the disclosed mixer are less sensitive to the mixing rate. Since it is known that the cubicity of AgCl photographic emulsions affects their photographic performance, this result indicates that the disclosed mixer is more robust and offers improvements in the ease of scalability.

While the invention has been described with particular reference to the preferred embodiments, it will be understood by those skilled in the art that various changes may be made and equivalents may be substituted for elements of the preferred embodiments without departing from invention. For example, while the impeller diameters have been described as equal, the upper and lower impellers can have different diameters or operate at different speeds rather than the same speed. Also, the reactants can be introduced by a multitude of tubes at various locations in the draft tube and with various orifice designs, as well as other dopants can be added similarly. And while the present invention has been described with reference to silver halide emulsions for photographic use, other emulsions can be mixed with the equipment using the principles of operation of the mixer. It is accordingly intended that the claims shall cover all such modifications and applications as do not depart from the true spirit and scope of the invention.

What is claimed is:

1. A scalable apparatus for preparing a predetermined volume of silver halide emulsion in a containment vessel, comprising:

a vertically oriented draft tube arranged in said containment vessel, a bottom impeller positioned in said draft tube for dissipating power into said silver halide emulsion;

a top impeller positioned in said draft tube above said bottom impeller for producing a pumping rate of said silver halide emulsion, the top impeller being arranged in a spaced relations in said draft tube from the bottom impeller by a distance sufficient for independent operation of said bottom impeller and said top impeller, said bottom impeller having a power dissipation P defined by the equation $$P=\rho N_p n^3 D^5,$$

wherein ρ is density of the mixture,
$N_p$ is the power number,
n is mixing speed, and
D is the diameter of the lower impeller;
and wherein said top impeller has a pumping rate Q defined by the equation $$Q=N_q n D^3,$$

where $N_q$ is the flow number,
n is mixing speed, and
D is the diameter of the upper impeller;
and, wherein scaling from a first volume $V_1$ of silver halide emulsion to a second volume $V_2$ of silver halide emulsion by a scaling factor $S=V_2/V_1$ is achieved by changing D according to the equation $$D_2=D_1 S^{1/3}$$

wherein $D_2$ is the diameter of said top impeller and said bottom impeller appropriate for said second volume $V_2$ of silver halide emulsion, and wherein $D_1$ is the diameter of said top impeller and said bottom impeller appropriate for said first volume $V_1$ of silver halide emulsion.

2. An apparatus, as set forth in claim 1, wherein said bottom impeller has a diameter and said top impeller is spaced from said bottom impeller a distance at least 50% of said diameter.

3. An apparatus, as set forth in claim 1, wherein said bottom impeller has a plurality of blades each having a vertically oriented working surface, and said top impeller has a plurality of blades each having a working surface oriented in a range of about 15 to 45 degrees from horizontal.

4. An apparatus, as set forth in claim 1, wherein said top and bottom impellers rotate at the same rotational speed.

5. An apparatus, as set forth in claim 1, wherein said top impeller has a plurality of blades each having a working surface oriented from horizontal to direct fluid upward in said draft tube.

6. An apparatus, as set forth in claim 1, including at least one baffle positioned in said draft tube.

7. An apparatus, as set forth in claim 1, a plurality of baffles positioned in said draft tube to discourage vortexing and air entrainment.

8. An apparatus, as set forth in claim 7, wherein said baffles are uniformly spaced about an inner periphery of said draft tube.

9. An apparatus, as set forth in claim 7, wherein said baffles extend the length of said draft tube.

10. An apparatus, as set forth in claim 7, wherein said baffles are spaced from said sidewall of said draft tube.

11. An apparatus, as set forth in claim 1, including:

a motor for rotating said impellers;

a shaft connecting said motor and said impellers; and a disrupter mounted on said shaft above said draft tube.

12. An apparatus, as set forth in claim 1, wherein said draft tube has a vertical axis and including:

a first inlet for silver reactant; and a second inlet for halide reactant, said first and second inlets being aligned along a diameter of said draft tube and positioned on opposite sides of said vertical axis.

13. An apparatus, as set forth in claim 1, wherein physical dimensions of said apparatus are scalable upward geometrically by a factor of the cube root of a scale factor.

14. An apparatus, as set forth in claim 1, wherein said bottom impeller has a diameter and said top impeller is spaced from said bottom impeller a distance at least 75% of said diameter.

15. An apparatus, as set forth in claim 1, wherein said bottom impeller has a diameter and said top impeller is spaced from said bottom impeller a distance at least 100% of said diameter.

* * * * *